US006152572A

United States Patent [19]

Cutler

[11] Patent Number: 6,152,572

[45] Date of Patent: Nov. 28, 2000

[54] HANDBAG INTERIOR ILLUMINATION SYSTEM

[76] Inventor: Linda M. Cutler, 2 Turner La., Lancaster, Mass. 01523

[21] Appl. No.: 09/288,135

[22] Filed: Apr. 8, 1999

[51] Int. Cl.[7] ..... F21V 33/00

[52] U.S. Cl. ..... 362/155; 362/156; 362/219; 362/249

[58] Field of Search ..... 362/156, 154, 362/155, 249, 252, 184, 190, 191, 219, 551

[56] References Cited

U.S. PATENT DOCUMENTS 5,073,844 12/1991 Coyner et al. ..... 362/156

5,249,106 9/1993 Barnes et al. ..... 362/108

5,879,076 3/1999 Cross ..... 362/555

*Primary Examiner*—Thomas M. Sember

[57] ABSTRACT

A handbag interior illumination system for shining light on to the contents therein. The handbag interior illumination system includes an elongate flexible tube with a pair of elongate flexible attachment strips coupled to opposite sides of the tube. A light source is disposed in the lumen of the tube. A battery is electrically connected to the light source. The tube is designed for positioning along an periphery of the mouth in a ring shaped configuration such that the proximal end of the tube is positioned adjacent the distal end of the tube. The attachment strips are designed for coupling to the compartment of the handbag.

8 Claims, 3 Drawing Sheets

HANDBAG INTERIOR ILLUMINATION SYSTEM

BACKGROUND OF THE INVENTION

1. Field of the Invention

The present invention relates to handbags with illuminated interiors and more particularly pertains to a new handbag interior illumination system for shining light on to the contents therein.

2. Description of the Prior Art

The use of handbags with illuminated interiors is known in the prior art. More specifically, handbags with illuminated interiors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,067,063; 2,218,396; U.S. Pat. No. Des. 343,060; U.S. Pat. Nos. 5,005,111; 4,376,935; and 5,424,926 which are all incorporated herein by reference.

While these devices fulfill their respective, particular objectives and requirements, the aforementioned patents do not disclose a new handbag interior illumination system. The inventive device includes an elongate flexible tube with a pair of elongate flexible attachment strips coupled to opposite sides of the tube. A light source is disposed in the lumen of the tube. A battery is electrically connected to the light source. The tube is designed for positioning along an periphery of the mouth in a ring shaped configuration such that the proximal end of the tube is positioned adjacent the distal end of the tube. The attachment strips are designed for coupling to the compartment of the handbag.

In these respects, the handbag interior illumination system according to the present invention substantially departs from the conventional concepts and designs of the prior art, and in so doing provides an apparatus primarily developed for the purpose of shining light on to the contents therein.

SUMMARY OF THE INVENTION

In view of the foregoing disadvantages inherent in the known types of handbags with illuminated interiors now present in the prior art, the present invention provides a new handbag interior illumination system construction wherein the same can be utilized for shining light on to the contents therein.

The general purpose of the present invention, which will be described subsequently in greater detail, is to provide a new handbag interior illumination system apparatus and method which has many of the advantages of the handbags with illuminated interiors mentioned heretofore and many novel features that result in a new handbag interior illumination system which is not anticipated, rendered obvious, suggested, or even implied by any of the prior art handbags with illuminated interiors, either alone or in any combination thereof.

To attain this, the present invention generally comprises an elongate flexible tube with a pair of elongate flexible attachment strips coupled to opposite sides of the tube. A light source is disposed in the lumen of the tube. A battery is electrically connected to the light source. The tube is designed for positioning along an periphery of the mouth in a ring shaped configuration such that the proximal end of the tube is positioned adjacent the distal end of the tube. The attachment strips are designed for coupling to the compartment of the handbag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handbag interior illumination system apparatus and method which has many of the advantages of the handbags with illuminated interiors mentioned heretofore and many novel features that result in a new handbag interior illumination system which is not anticipated, rendered obvious, suggested, or even implied by any of the prior art handbags with illuminated interiors, either alone or in any combination thereof.

It is another object of the present invention to provide a new handbag interior illumination system which may be easily and efficiently manufactured and marketed.

It is a further object of the present invention to provide a new handbag interior illumination system which is of a durable and reliable construction.

An even further object of the present invention is to provide a new handbag interior illumination system which is susceptible of a low cost of manufacture with regard to both materials and labor, and which accordingly is then susceptible of low prices of sale to the consuming public, thereby making such handbag interior illumination system economically available to the buying public.

Still yet another object of the present invention is to provide a new handbag interior illumination system which provides in the apparatuses and methods of the prior art some of the advantages thereof, while simultaneously overcoming some of the disadvantages normally associated therewith.

Still another object of the present invention is to provide a new handbag interior illumination system for shining light on to the contents therein.

Yet another object of the present invention is to provide a new handbag interior illumination system which includes an elongate flexible tube with a pair of elongate flexible attachment strips coupled to opposite sides of the tube. A light source is disposed in the lumen of the tube. A battery is electrically connected to the light source. The tube is designed for positioning along an periphery of the mouth in a ring shaped configuration such that the proximal end of the tube is positioned adjacent the distal end of the tube. The attachment strips are designed for coupling to the compartment of the handbag.

Still yet another object of the present invention is to provide a new handbag interior illumination system that has a light source that is easily installable into any handbag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
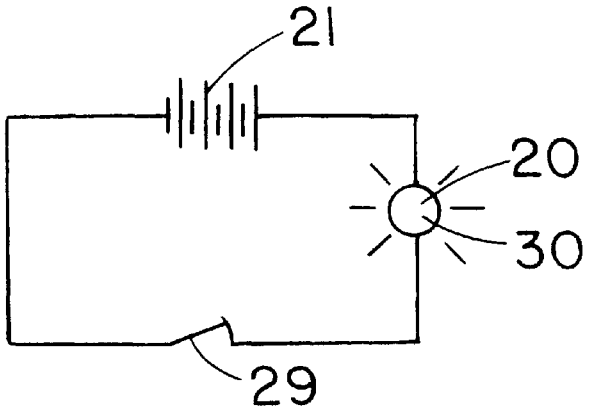
FIG. 2 is an electrical schematic of the present invention.

With reference now to the drawings, and in particular to FIGS. 1 through 5 thereof, a new handbag interior illumination system embodying the principles and concepts of the present invention will be described.

As best illustrated in FIGS. 1 through 5, the handbag interior illumination system generally comprises an elongate flexible tube with a pair of elongate flexible attachment strips coupled to opposite sides of the tube. A light source is disposed in the lumen of the tube. A battery is electrically connected to the light source. The tube is designed for positioning along an periphery of the mouth in a ring shaped configuration such that the proximal end of the tube is positioned adjacent the distal end of the tube. The attachment strips are designed for coupling to the compartment of the handbag.

In closer detail, the handbag interior illumination system comprises a translucent or transparent elongate flexible tube 10 having a lumen 11 and opposite proximal and distal ends 12,13. The tube is flexible to permit bending of the tube in directions transverse to a longitudinal axis of the tube defined between the proximal and distal ends of the tube.

The tube has elongate front and back regions 14,15 extending between the proximal and distal ends of the tube. The front and back regions each have a generally semicircular arcuate transverse cross section taken perpendicular to the longitudinal axis of the tube. The back region of the tube has inwardly facing reflective surface 16 for reflecting light in the lumen of the tube towards the front region of the tube. The reflective surface may be provided in the lumen or, as illustrated on FIG. 5, on the exterior surface of the tube.

A pair of generally rectangular elongate flexible attachment strips 17,18 are coupled to the opposite sides of the tube such that the tube is interposed between the attachment strips and the attachment strips extend substantially across the length of the tube between the proximal and distal ends of the tube. Ideally, the attachment strips each comprise a flexible fabric material such as the type used for securing a zipper to a garment with stitching.

In an ideal illustrative embodiment, the tube has an outer diameter of about ¼ inch and an outer width is defined between outer side edges of the attachment strips of about 1 inch.

Figure 3:
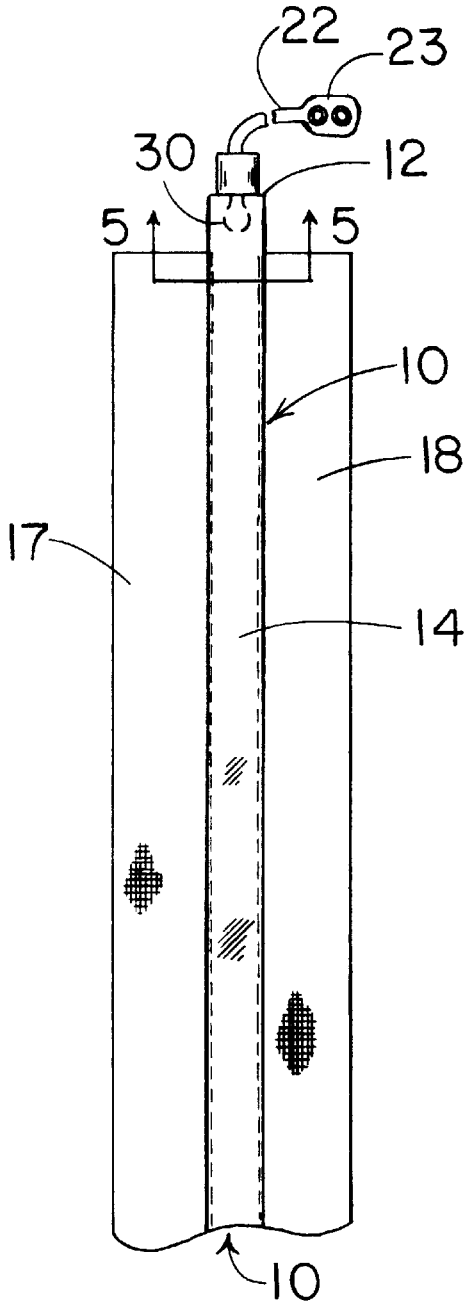
FIG. 3 is a schematic partial plan view of a single light source embodiment of the present invention.
Figure 4:
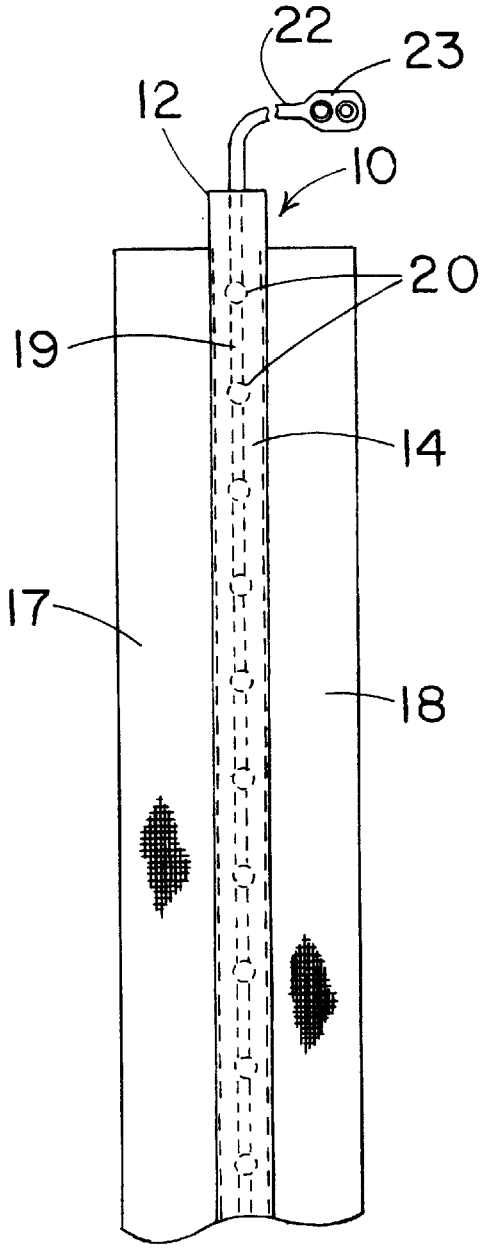
FIG. 4 is a schematic partial plan view of an embodiment of the present invention with a row of light sources in the lumen of the tube.
Figure 5:
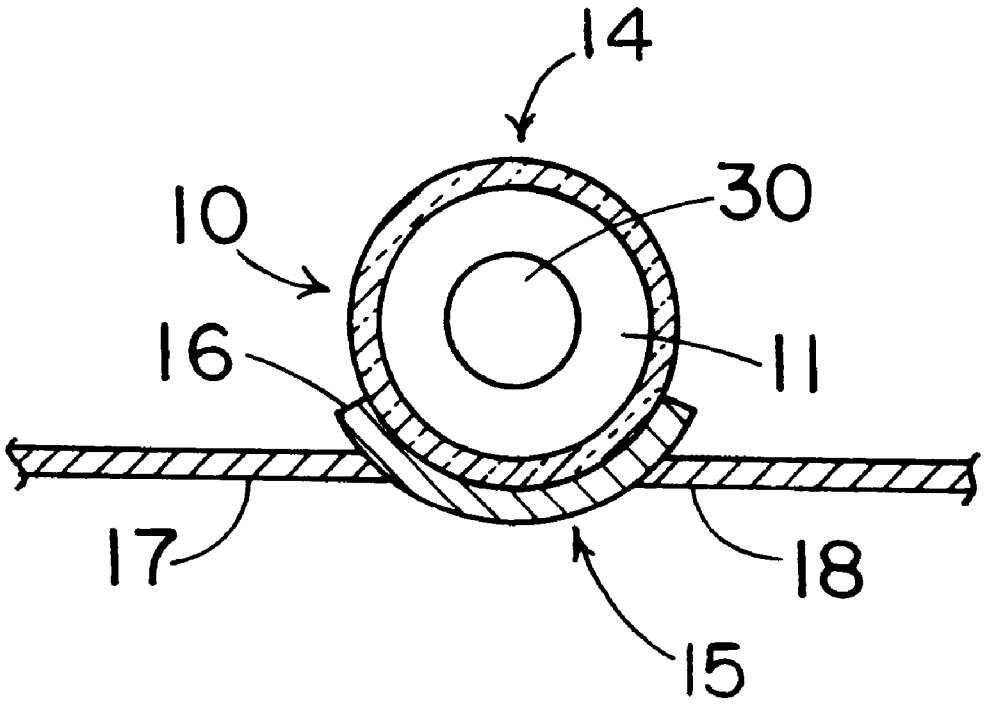
FIG. 5 is a schematic transverse cross section view of the tube of the embodiment of the present invention illustrated in FIG. 3 taken from line 5—5 of FIG. 3.

A light source is disposed in the lumen of the tube. As illustrated in FIG. 3, in a first preferred embodiment, the light source 30 is positioned at the proximal end of the tube. In another preferred embodiment depicted in FIG. 4, the light source comprises a plurality of spaced apart and electrically connected by electrical conduit 19 light sources 20 arranged in a row extending through the lumen between the proximal and distal ends of the tube. Ideally, the light sources are spaced apart at generally equal intervals in the row. In either embodiment, the light sources may ideally comprise a light bulb or a light emitting diode.

A battery 21 is electrically connected to the light source for providing energy to the light source for illuminating the light source. Ideally, the battery comprises a generally rectangular nine-volt battery with a pair of terminals at one end of the battery. Preferably, an elongate electrical conduit 22, such as a coated electrical wire, electrically connects the light source to the battery. The electrical conduit is outwardly extended from the proximal end of the tube. The electrical conduit preferably has a battery connector 23 detachably attaching and electrically connecting the terminals of the battery to the electrical conduit.

Figure 1:
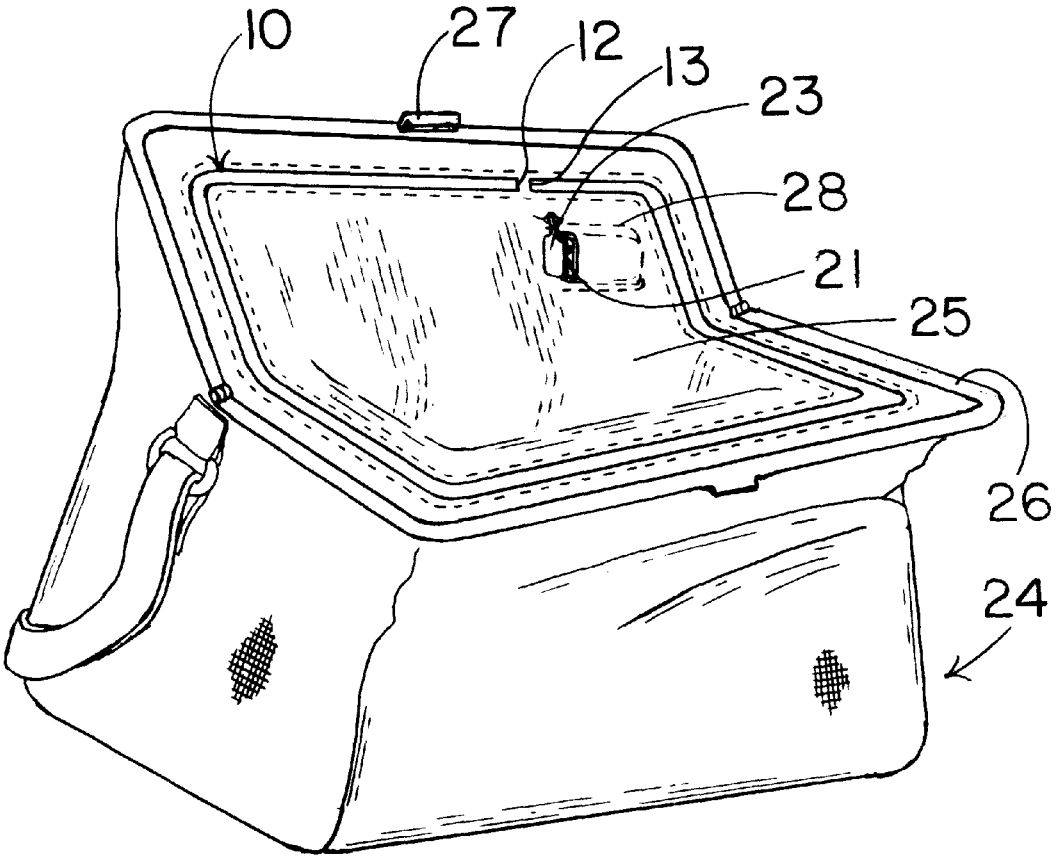
FIG. 1 is a schematic perspective view of a new handbag interior illumination system with the mouth of the compartment of the handbag in an open position according to the present invention.

A handbag 24, such as a purse or a pocketbook, is provided having a compartment 25 in the interior of the handbag. The compartment has a closable mouth 26 providing an opening into the compartment and a latch 27 for releasably holding the mouth in a closed position. As illustrated in FIG. 1, the tube is positioned along an periphery of the mouth in a generally rectangular ring shaped configuration such that the proximal end of the tube is positioned adjacent the distal end of the tube. The attachment strips are coupled to the compartment of the handbag, ideally by stitching. The battery is attached to the compartment of the handbag preferably by insertion into a pocket 28 in the compartment.

In an preferred embodiment, a switch 29 is electrically connected to the light source between the light source and the battery for selectively activating the light source. Ideally, the switch has an actuator operatively connected to the latch such that the actuator generates a first signal when the latch is holding the mouth of the compartment in a closed position and a second signal when the latch is released to permit opening of the mouth of the handbag. The switch is thrown closed and thereby activates the light source upon receiving the first signal and is thrown open and thereby deactivates the light source upon receiving the second signal.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handbag interior illumination system, comprising:

an elongate flexible tube comprising a translucent material and having a lumen and opposite proximal and distal ends;

a pair of elongate flexible attachment strips being coupled to opposite sides of said tube extended between said proximal and distal ends of said tube;

a light source being disposed in said lumen of said tube;

a battery being electrically connected to said light source;

wherein said tube is adapted for positioning along a periphery of a mouth of the handbag in a ring shaped configuration such that said proximal end of said tube is positioned adjacent said distal end of said tube, wherein said attachment strips are adapted for coupling to the compartment of the handbag;

a switch electrically connected to said light source between said light source and said battery for selectively activating said light source; and wherein said switch has an actuator operatively connected to a latch of the handbag such that said actuator generates a first signal when the latch is holding the mouth of the compartment in a closed position and a second signal when the latch is released to permit opening of the mouth of the handbag, wherein said switch activates said light source upon receiving said first signal and deactivates said light source upon receiving said second signal.

2. The handbag interior illumination system of claim 1, wherein said tube has elongate front and back regions extending between said proximal and distal ends of said tube, and wherein said back region of said tube has inwardly facing reflective surface for reflecting light in said lumen of said tube towards said front region of said tube.

3. The handbag interior illumination system of claim 1, wherein said light source is positioned at said proximal end of said tube.

4. The handbag interior illumination system of claim 1, wherein said light source comprises a plurality of spaced apart and electrically connected light sources arranged in a row extending through said lumen between said proximal and distal ends of said tube.

5. The handbag interior illumination system of claim 1, wherein an elongate electrical conduit electrically connects said light source to said battery, said electrical conduit being outwardly extended from said proximal end of said tube.

6. A handbag interior illumination system, comprising:

an elongate flexible tube comprising a translucent material and having a lumen and opposite proximal and distal ends;

said tube having elongate front and back regions extending between said proximal and distal ends of said tube, said front and back regions each having a generally semi-circular arcuate transverse cross section;

said back region of said tube having inwardly facing reflective surface for reflecting light in said lumen of said tube towards said front region of said tube;

a pair of generally rectangular elongate flexible attachment strips being coupled to said opposite sides of said tube such that said tube is interposed between said attachment strips and said attachment strips extend between said proximal and distal ends of said tube;

a light source being disposed in said lumen of said tube;

a battery being electrically connected to said light source, wherein an elongate electrical conduit electrically connects said light source to said battery, said electrical conduit being outwardly extended from said proximal end of said tube, said electrical conduit having a battery connector detachably attaching and electrically connecting said battery to said electrical conduit;

a handbag having a compartment, said compartment having a closable mouth and a latch for releasably holding said mouth in a closed position;

said tube being positioned along a periphery of said mouth in a ring shaped configuration such that said proximal end of said tube is positioned adjacent said distal end of said tube;

said attachment strips being coupled to said compartment of said handbag, wherein stitching couples each of said attachment strips to said compartment of said handbag;

said battery being attached to said compartment of said handbag, wherein said battery is inserted into a pocket in said compartment to attach said battery to said compartment to attach said battery to said compartment of said handbag;

a switch electrically connected to said light source between said light source and said battery for selectively activating said light source; and wherein said switch has an actuator operatively connected to said latch such that said actuator generates a first signal when said latch is holding said mouth of said compartment in a closed position and a second signal when said latch is released to permit opening of said mouth of said handbag, wherein said switch activates said light source upon receiving said first signal and deactivates said light source upon receiving said second signal.

7. The handbag interior illumination system of claim 6, wherein said light source is positioned at said proximal end of said tube.

8. The handbag interior illumination system of claim 6, wherein said light source comprises a plurality of spaced apart and electrically connected light sources arranged in a row extending through said lumen between said proximal and distal ends of said tube, and wherein said light sources are spaced apart at generally equal intervals in said row.

* * * * *